US005893185A

United States Patent [19]

Okrepkie et al.

[11] Patent Number: 5,893,185

[45] Date of Patent: Apr. 13, 1999

[54] MULTIPURPOSE ELECTRICIANS HAND TOOL

[76] Inventors: Joseph Okrepkie, 993 Dalton Hill Rd., Newark Valley, N.Y. 13811; Ralph Okrepkie, 93 Canterbury La., Trumbull, Conn. 06611

[21] Appl. No.: 08/767,526

[22] Filed: Dec. 16, 1996

[51] Int. Cl.[6] ..... B25F 1/00

[52] U.S. Cl. ..... 7/107; 7/108; 7/137; 7/143; 7/164; 81/9.44; 30/90.6

[58] Field of Search ..... 7/107, 108, 125, 7/137, 143, 164; 81/9.4, 9.44; 30/90.6

[56] References Cited

U.S. PATENT DOCUMENTS

| | | | |
|---|---|---|---|
| 70,529 | 11/1867 | Collier . | |
| 95,793 | 10/1869 | Granier . | |
| 114,665 | 5/1871 | Garrick . | |
| D. 255,539 | 6/1980 | Graham . | |
| 276,793 | 5/1883 | Erdman et al. . | |
| 2,400,177 | 5/1946 | Tomsick | 30/90.6 |
| 2,668,464 | 2/1954 | Paules | 7/107 X |
| 3,119,424 | 1/1964 | Henry | 7/143 X |
| 3,360,018 | 12/1967 | Lindsay . | |
| 3,777,323 | 12/1973 | Ingram | 7/107 |
| 4,070,930 | 1/1978 | Oprins | 30/90.6 X |
| 4,244,067 | 1/1981 | Rowe . | |
| 4,741,059 | 5/1988 | Lee et al. . | |
| 4,953,248 | 9/1990 | Trombetta . | |
| 4,995,128 | 2/1991 | Montgomery et al. . | |
| 5,084,935 | 2/1992 | Kalthoff . | |
| 5,205,006 | 4/1993 | Panasuk | 7/108 |
| 5,245,721 | 9/1993 | Lowe et al. . | |
| 5,280,659 | 1/1994 | Park | 7/107 X |

*Primary Examiner*—James G. Smith
*Attorney, Agent, or Firm*—McCormick, Paulding & Huber

[57] ABSTRACT

A multi-purpose hand tool comprises first and second body members pivotally connected for movement between an open and a closed position. The body members include handle portions, and define first and second opposed cutting sections positioned between the pivotal connection and the handle portions. A bit retainer extends from the second body member and is adapted to receive a plurality of different tool bits. A clip is provided on one of the body members for retaining the various tool bits. The multi-purpose hand tool also includes a hammer section extending from the second body member perpendicular to the first body member, thereby defining a square. A plurality of apertures corresponding to a plurality of standard wire gage sizes, as well as a plurality of sharpened apertures for stripping differently sized wires are also defined by the first and second body members. The multi-purpose hand tool further includes a crimping tool, wire cutter and wire stripper.

11 Claims, 1 Drawing Sheet

MULTIPURPOSE ELECTRICIANS HAND TOOL

FIELD OF THE INVENTION

The present invention relates generally to hand tools, and more particularly to a multi-purpose hand tool incorporating several individual tools commonly used by an electrician.

BACKGROUND OF THE INVENTION

An electrician usually carries his tools to a job site in either a tool box or in a tool belt, both of which can be heavy and cumbersome. Often, the area where the electrician must work is not readily accessible, and the electrician must work off of a ladder or in a crawl space thereby requiring the tool box or belt to be left in an unhandy location. Since several tools are typically needed to complete a given job, the electrician may have to make several trips up and down the ladder, or into and out of the crawl space to retrieve the tools required. This increases the time needed to complete the job, and adds to the fatigue and risk of injury to the electrician.

One means by which the number of tools needed for a given job can be reduced, and thereby the number of trips required to and from the tool box minimized, is to employ tools that are capable of aiding in the performance of several different tasks. However, known multi-purpose tools do not incorporate many features needed by the electrician. For example, the cable used to wire houses or buildings typically consists of three or four wires covered by a heavy polymeric, typically vinyl, sheath. Due to the relatively large thickness of both the cable and its sheath, larger cutters and cable slitters are required to cut and strip the cable. Known multi-purpose tools do not incorporate such cutters and slitters.

In addition, electricians and maintenance personnel are often called upon to perform tasks which require skills in other disciplines, such as carpentry or metal working. These other disciplines each require that the craftsman carry additional tools thereby exacerbating the previously described difficulties.

Based on the foregoing, it is the general object of the present invention to provide a multi-purpose hand tool incorporating the tools most commonly used by an electrician.

It is an additional object of the present invention to supply such a tool capable of effectively working with cable of large diameter or thickness.

It is still a further object of the present invention to provide a multi-purpose tool capable of being used to perform tasks in multiple disciplines.

Other objects and advantages of the invention will be apparent from the following detailed description of the preferred embodiment of the invention.

SUMMARY OF THE INVENTION

The present invention meets these and other objects by providing, in one aspect, a multi-purpose hand tool having first and second body members, each defining a handle section. A connection means pivotally joins the first and second body members for movement between an open and a closed position, with the first and second body members further defining opposed first and second cutting sections positioned between the connection means and the handle sections, and in communication with each other when the first and second body members are in the closed position. In addition, the multi-purpose hand tool includes a bit retainer extending from the second body member and adapted to receive a tool bit, such as a conventional socket or screwdriver.

The multi-purpose hand tool in accordance with the principles of the present invention also comprises several other different tool functions. For example, one of the first or second body members defines a plurality of apertures corresponding to various standard wire gage sizes. A crimping tool is provided between the previously described connection means and handle sections, whereby one body member defines an arcuate anvil portion upon which a crimpable connector is positioned, and the other body member defines a crimping portion positioned opposite the anvil portion, such that when the first and second body members are moved to the closed position, the connector is crimped.

In a related aspect, a hammer section extends from and is substantially perpendicular to the first body member such that when the first and second body members are in the closed position, the hammer section and the first body member cooperate to form a square. The hammer section further comprises a front surface defining a first slot that extends part way into the hammer section and a second slot extending through the hammer section substantially perpendicular to the first slot, and adapted to receive an end of the first body member. The first slot is positioned such that the second slot bifurcates the first slot into two slot sections. When the first and second body members are in the open position, the bifurcated slot sections are unobstructed. However, when the first and second body members are moved from the open to the closed position, the end of the first body member gradually obstructs the first slot between the bifurcated slot sections. This coaction between the end of the first body member and the bifurcated slot sections forms a wire cutter, whereby a wire placed in the first slot will be cut by the end of the first body member as it passes between the bifurcated slot sections.

In a further aspect of the present invention, the first and second body members each define a plurality of opposed sharpened semicircular slots positioned between the above-described connection means and handle sections on the first and second body members, such that when the first and second body members are in the closed position, the semicircular slots cooperate to define sharpened circular apertures of various sizes for stripping the insulation off of differently sized electrical conductors.

In still another aspect, a respective one of said first or second body members includes a hook-shaped proturbance extending from the handle section and used to remove staples.

In yet another aspect of the present invention, a respective one of either the first or second body members includes a recess located between the handle section and the connection means, and the other body member includes a cutter extending from the body member into the recess, such that a cable insulation slitter is formed when the first and second body members are in the closed position.

BRIEF DESCRIPTION OF THE DRAWINGS

A more complete understanding of the invention and many of the attendant advantages thereto will be readily appreciated from the following detailed description when considered in conjunction with the accompanying drawings wherein corresponding reference characters indicate corresponding parts throughout the several views of the drawings and wherein.

DETAILED DESCRIPTION OF THE PREFERRED EMBODIMENT

Figure 1:
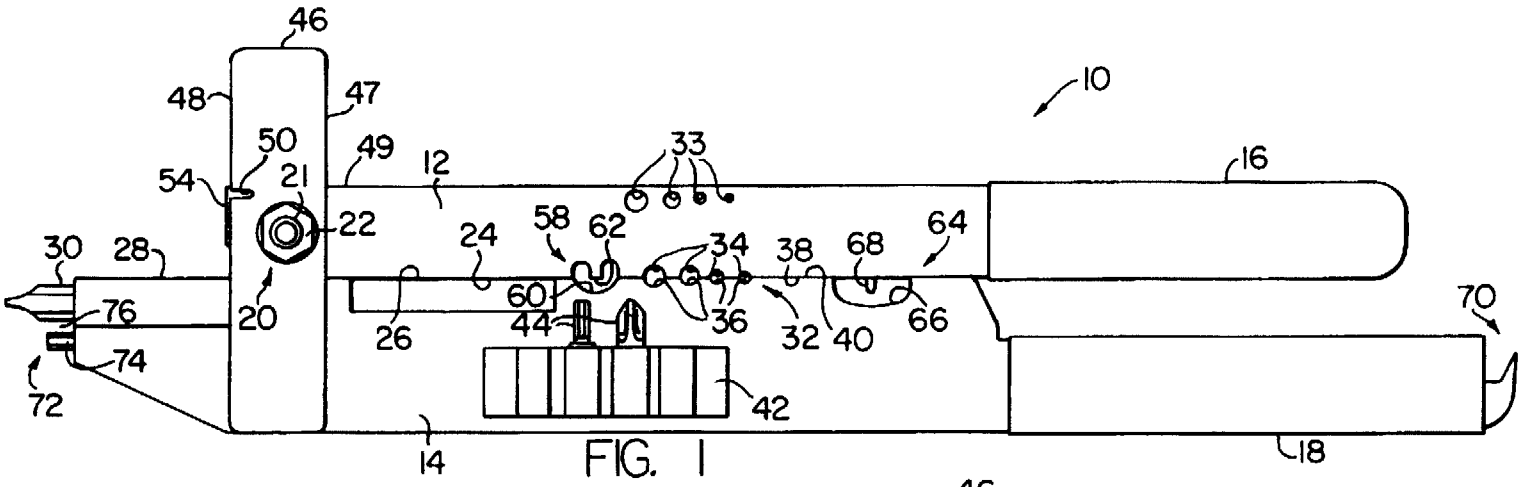
FIG. 1 is a side elevational view of the multi-purpose tool of the present invention.

Turning to the drawings and first referring to FIG. 1, the multi-purpose hand tool of the present invention is there shown, and is identified by the reference numeral 10. The multi-purpose hand tool comprises first and second body members, 12 and 14 respectively, that define first and second handle sections, 16 and 18. The first and second body members 12 and 14 are pivotally connected to each other for movement between an open and a closed position by connection means 20 which preferably comprises a bolt 21 that extends through the body members and is held in position by nut 22. While a nut and bolt are shown and described, many other types of connection means known to those skilled in the art may be substituted without departing from the broader aspects of the invention. In addition to the handle sections 16 and 18, the first and second body members 12 and 14 further define directly opposed first and second cutting sections 24 and 26 positioned between the connection means 20 and the handle sections 16 and 18. Cutting sections 24 and 26 are in cutting engagement when the first and second body members are in the closed position and are sized to cut through large diameter cable and electrical conductors. Preferably, one the cutting sections 24 or 26 defines an anvil portion for supporting the cable or electrical conductor while the other cutting section defines a blade portion for cutting through the cable or electrical conductor.

Still referring to FIG. 1, the multi-purpose hand tool 10 also includes a bit retainer 28 adapted to slidably receive a tool bit 30. While the tool bit 30 is illustrated as a flat blade screw driver in FIG. 1, the invention is not limited in this regard as other tool bits, such as Phillips head screwdrivers, or sockets may be substituted without departing from the broader aspects of the present invention.

The multi-purpose hand tool 10 further provides a plurality of sharpened circular apertures 32 for stripping the insulation off of differently sized wires. The apertures 32 are defined by a plurality of opposed sharpened semicircular slots 34 and 36 extending into the first and second body members 12 and 14 from edges 38 and 40 respectively. When the first and second body members are in the previously described closed position, the sharpened semicircular slots 34 and 36 mate to form the aforementioned sharpened circular apertures 32.

The multi-purpose hand tool 10 also includes a plurality of apertures 33 corresponding to various different wire gage sizes, defined by the first or second body members 12 and 14.

Still referring to FIG. 1, the multi-purpose hand tool of the present invention includes a bit storage clip 42 mounted to the second body member 14 and adapted to receive and releasably retain a plurality of tool bits 44 for use with the previously described bit retainer 28.

Figure 2:
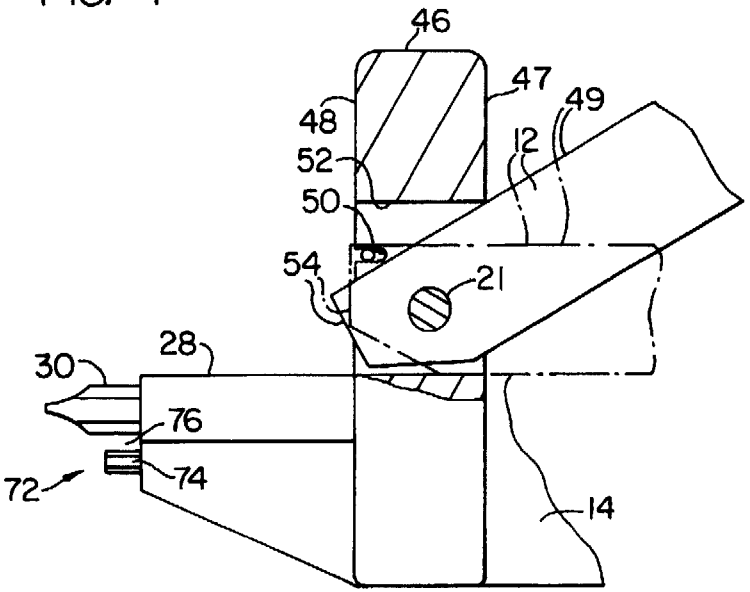
FIG. 2 is an enlarged view of the hammer/wire cutter section of the multi purpose tool of FIG. 1 shown in the open position.
Figure 3:
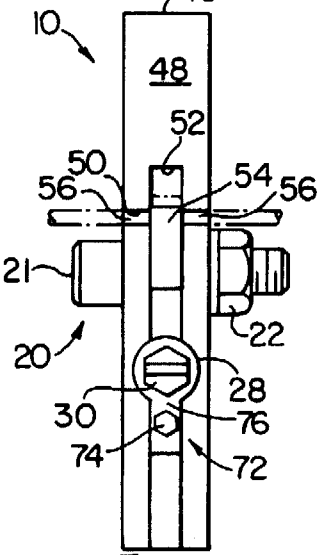
FIG. 3 is an enlarged end view of the hammer/wire cutter section of the multi purpose tool of FIG. 1.

Turning now to FIGS. 1–3, the multi-purpose hand tool 10 includes a hammer section 46 attached to, and extending perpendicularly from the second body member 12. In the preferred embodiment, the hammer section 46 is integral with the second body member 14, however, the invention is not limited in this regard. In addition, the hammer section 46 has a front surface 48 that defines a first slot 50 which extends from the front surface part way into the hammer section. A second slot 52, best seen in FIG. 2 is also defined by the hammer section and is adapted to slidably receive an end 54 of the first body member 12, the second slot 52 extends through the hammer section perpendicularly intersecting and bifurcating the first slot into two slot sections 56, 56. When the first and second body members are in the above-described open position, the end 54 of the first body member 12 slidably positioned in the second slot 52, is pivoted below the first slot 50, thereby leaving the first slot 50 unobstructed. As the first and second body members 12 and 14 are moved from the opened to the closed position, the end 54 of the first body member pivots in the second slot 52 between the bifurcated slot sections 56, 56 until the first body member completely obstructs the first slot 50. As such, the coaction of the end 54 of the first body member 12 and the bifurcated slot sections 56, 56 form a wire cutter, best understood with reference to FIGS. 2 and 3, whereby a wire slid into the first slot 50 and across the bifurcated slot sections 56, 56 will be cut by the edges of the bifurcated slot sections 56, 56 as the end 54 of the first body section 12 passes between the slot sections.

The hammer section 46 also has a rear surface 47 which is substantially perpendicular to an upper edge 49 of the first body member 12, thereby defining a square when the first and second body members 12 and 14 are in the closed position.

Referring back to FIG. 1, the multi-purpose hand tool 10 further includes a crimping tool 58 positioned between the connection means 20 and the handle portions 16,and 18. Crimping tool 58 is defined by an arcuate anvil portion 60, and an opposed crimping portion 62. The arcuate anvil portion 60 extends into the second body member 14 from edge 40 and the crimping portion 62 extends from the first body portion 12 and is substantially centered in the arcuate anvil portion 60 when the first and second body members, 12 and 14 respectively are in the closed position. In operation, a wire connector is placed on the arcuate anvil portion 60 while the first and second body members are in the open position. As the first and second body members 14 and 16 are moved to the closed position, the crimping portion contacts the connector and crimps it. While the arcuate anvil portion 60 has been described as extending into the second body member 14, and the crimping portion 62 has been described as extending from the first body member 12, the invention is not limited in this regard as the arcuate anvil portion could extend into the first body member and the crimping portion could extend from the second body member without departing from the broader aspects of the present invention.

The first and second body members, 12 and 14 respectively, also define a cable insulation slitter 64. The cable insulation slitter 64 comprises a recess 66 defined by the second body member 14, and an opposed cutter 68 extending from the first body member 12 part-way into the recess 66. The cable insulation slitter 64 is located between the connection means 20 and the handle portions 16 and 18. In operation a piece of cable is positioned in the recess 66 when the first and second body members, 12 and 14 respectively, are in the open position. When the first and second body members are moved to the closed position, the cutter 68 pierces the cable's insulation, and the cable can then be pulled through the slitter, thereby cutting through the insulation along the cable's length.

The multi-purpose hand tool 10 also includes a staple puller 70. The staple puller 70 is defined by a hook shaped proturbance extending from either one of the first or second handle portions 16 or 18 respectively.

In addition to the above, the tool holder further includes a wire bending device 72 comprised of a rod member 74 extending from the second body member 14 and spaced apart from the bit retainer 28, forming a gap 76 therebetween. A wire or rod can be placed in the gap 76 and subsequently bent around the rod member 74.

While preferred embodiments have been shown and described, various modifications and substitutions may be made without departing from the spirit and scope of the present invention. Accordingly, it is to be understood that the present invention has been described by way of example and not by limitation.

What is claimed is:

1. A multi-purpose hand tool comprising:

a first body member defining a first handle section;

a second body member defining a second handle section;

a bit retainer, extending from said second body member and adapted to receive a tool bit;

connection means for pivotally connecting said first and second body members for movement between an open and a closed position;

said first body member defining a first cutting section positioned between said connection means and said first handle section;

said second body member defining a second cutting section located opposite said first cutting section when said first and second body members are in said closed position;

a hammer section integral with and extending perpendicularly from said second body member:

said hammer section having a front surface and defining a first slot extending from said front surface part way into said hammer section, and a second slot adapted to slidably receive an end of said first body member, said second slot extending through said hammer section perpendicularly intersecting and bifurcating said first slot into two slot sections; and said first slot being positioned in said hammer section such that said first slot is unobstructed when said first and second body members are in said open position, and said end of said first body member obstructing said first slot between said bifurcated slot sections when said first and second body members are in said closed position, thereby defining a wire cutter, whereby a wire positioned in said second slot will be cut by the coaction of said end of said first body member and said bifurcated slot sections when said body members are moved from said open to said closed position.

2. A multi-purpose hand tool as defined in claim 1, further comprising:

at least one tool bit; and a bit storage clip mounted to a respective one of said first or second body members and adapted to releasably receive and retain a plurality of tool bits for reception by said bit retainer.

3. A multi-purpose hand tool as defined in claim 1 wherein said first cutting section defines a blade portion, and said second cutting section defines an anvil portion; and wherein said blade portion is in cutting communication with said anvil portion when said first and second body members are in said closed position.

4. A multi-purpose hand tool as defined in claim 1 wherein said first cutting section defines an anvil portion, and said second cutting section defines a blade portion; and wherein said blade portion is in communication with said anvil portion when said first and second body members are in said closed position.

5. A multi-purpose hand tool as defined by claim 1 wherein one of said first and second body members defines a plurality of apertures corresponding to a plurality of standard wire gage sizes.

6. A multi-purpose hand tool as defined by claim 1 wherein:

said first body member has an upper edge substantially perpendicular to said hammer section; and said hammer section and said upper edge cooperate to define a square when said first and second body members are in said closed position.

7. A multi-purpose hand tool as defined by claim 1 wherein a respective one of either said first or second body members further define a hook-shaped proturbance extending from said handle section for removing staples.

8. A multi-purpose hand tool as defined by claim 1 wherein:

a respective one of said first or second body members further defines an arcuate anvil portion positioned between said connection means and said handle section, for receiving a crimpable wire connector; and the other of said first or second body members defines a crimping portion positioned opposite said arcuate anvil portion and extending part way into said arcuate anvil portion when said first and second body members are in said closed position.

9. A multi-purpose hand tool as defined by claim 1 wherein:

said first and second body members define a plurality of directly opposed semicircular sharpened slots positioned between said connection means and said first and second handle sections, such that when said first and second body members are in said closed position, said semicircular sharpened slots cooperate to define a plurality of sharpened circular apertures for stripping the insulation off of wires.

10. A multi-purpose hand tool as defined by claim 1 wherein:

said bit retainer extends from an end of said second body member; and said second body member further includes a rod member extending from said end of said second body member and spaced apart from said bit retainer, forming a gap therebetween into which wire may be inserted and bent around said rod member.

11. A multi-purpose hand tool as defined by claim 1 wherein:

a respective one of said first or second body members defines a recess located between said connection means and said handle portion; and the other of said body members includes a cutter extending from said body member into said recess when said first and second body members are in said closed position, such that said recess and said cutter form a cable insulation slitter.

* * * * *